US008259018B2

(12) United States Patent
Lai et al.

(10) Patent No.: US 8,259,018 B2
(45) Date of Patent: Sep. 4, 2012

(54) COAXIAL ANTENNA DEVICE FOR USE WITH NON-MAGNETIC OPTION COUPLER

(75) Inventors: Yi-Chang Lai, Tauyuan Hsien (TW); Ying Yu Chiu, Tauyuan Hsien (TW)

(73) Assignee: Joymax Electronics Co., Ltd., Chongli Gonyeh Chu, Chongli Tauyuan Hsien (TW)

( * ) Notice: Subject to any disclaimer, the term of this patent is extended or adjusted under 35 U.S.C. 154(b) by 295 days.

(21) Appl. No.: 12/800,970

(22) Filed: May 25, 2010

(65) Prior Publication Data

US 2011/0291913 A1 Dec. 1, 2011

(51) Int. Cl.
*H01Q 1/32* (2006.01)
*H01Q 9/04* (2006.01)

(52) U.S. Cl. ..... 343/711; 343/713; 343/791

(58) Field of Classification Search ..... 343/711, 343/713, 715, 790, 791
See application file for complete search history.

(56) References Cited

U.S. PATENT DOCUMENTS

| | | | | |
|---|---|---|---|---|
| 3,852,759 | A | 12/1974 | Felsenheld et al. | |
| 5,616,043 | A | 4/1997 | Liou | |
| 5,668,564 | A * | 9/1997 | Seward et al. | 343/791 |
| 6,509,878 | B1 * | 1/2003 | Tornatta et al. | 343/715 |
| 6,642,899 | B2 * | 11/2003 | Strickland et al. | 343/773 |
| 6,661,387 | B2 | 12/2003 | Yang | |
| 6,747,603 | B1 | 6/2004 | Tornatta, Jr. et al. | |

* cited by examiner

*Primary Examiner* — Hoang V Nguyen
(74) *Attorney, Agent, or Firm* — Charles E. Baxley

(57) ABSTRACT

An antenna device includes a housing having a lower portion for coupling to a non-magnetic option coupler of a vehicle, an insulating member engaged in an upper chamber of the housing, a conductor member engaged into a central bore of the insulating member for engaging with the non-magnetic option coupler, a conductive coupling element having a lower portion engaged into the housing, and a coaxial radiating assembly includes a coaxial radiating device having a central radiating member for connecting to the conductor member, and a peripheral radiating member for connecting to the conductive coupling element, and an insulating element mounted between the central radiating member and the cylindrical radiating member.

5 Claims, 4 Drawing Sheets

COAXIAL ANTENNA DEVICE FOR USE WITH NON-MAGNETIC OPTION COUPLER

BACKGROUND OF THE INVENTION

1. Field of the Invention

The present invention relates to an antenna device for attaching onto various objects, and more particularly to a co-axial antenna device for use or for coupling to a non-magnetic option (NMO) coupler and for attaching onto vehicles or other objects and for preventing the antenna device from being damaged by other objects or while car washing.

2. Description of the Prior Art

Various kinds of typical antenna devices have been developed and arranged for attaching or mounting or securing onto vehicles or other objects, and comprise a coupling housing for connecting with an antenna member, an adaptor for attaching or mounting or securing onto the coupling housing, and a loading device received or engaged within or between the coupling housing and the adaptor for attaching or mounting or supporting an antenna element or the like.

For example, U.S. Pat. No. 3,852,759 to Felsenheld et al. discloses one of the typical broadband tunable antenna devices for use on moving vehicles and comprising a bar-shaped radiating element and a helical radiating element electrically insulated from each other by an air space between them.

However, normally, the radiating elements include a longitudinal structure that may have a chance to be bent or damaged by other objects or while car washing. For preventing the antenna device from being damaged by other objects or while car washing, the typical broadband tunable antenna devices should be disengaged from the moving vehicles.

U.S. Pat. No. 5,616,043 to Liou discloses another typical vehicle antenna connector comprising a coupling housing for connecting with an antenna member, an adaptor for attaching or mounting or securing onto the coupling housing, and a loading device received or engaged within or between the coupling housing and the adaptor for attaching or mounting or supporting an antenna element or the like.

However, the antenna member also includes a longitudinal structure that may have a chance to be bent or damaged by other objects or while car washing. For preventing the antenna device from being damaged by other objects or while car washing, the typical vehicle antenna connector should be disengaged from the moving vehicles.

U.S. Pat. No. 6,661,387 to Yang, and U.S. Pat. No. 6,747,603 to Tornatta, Jr. et al. disclose two further typical antenna devices or antenna mounting systems comprising an antenna member attached to a supporting base for mounting or securing onto vehicles or the like.

However, the antenna members also include a longitudinal structure that may have a chance to be bent or damaged by other objects or while car washing. For preventing the antenna device from being damaged by other objects or while car washing, the typical antenna devices or antenna mounting systems should also be disengaged from the moving vehicles.

The present invention has arisen to mitigate and/or obviate the afore-described disadvantages of the conventional antenna devices for vehicles.

SUMMARY OF THE INVENTION

The primary objective of the present invention is to provide an antenna device for coupling to a non-magnetic option coupler and for attaching onto vehicles or other objects and for preventing the antenna device from being damaged by other objects or while car washing.

In accordance with one aspect of the invention, there is provided an antenna device comprising a housing including a lower portion for coupling to a non-magnetic option coupler of a vehicle, and including a chamber formed in an upper portion thereof, an insulating member engaged in the chamber of the housing, and including a bore formed therein, a conductor member engaged into the bore of the insulating member for engaging with the non-magnetic option coupler, a conductive coupling element including a lower portion engaged into the chamber of the housing, and including a compartment formed therein for engaging with an upper portion of the insulating member, and a coaxial radiating assembly including a coaxial radiating device disposed in a sheath, and the coaxial radiating device including a central radiating member for electrically connecting to the conductor member, and including a peripheral radiating member for electrically connecting to the conductive coupling element, and including an insulating element mounted between the central radiating member and the cylindrical radiating member, and the coaxial radiating device includes a relatively reduced or decreased length for preventing the antenna device from being damaged by other objects or while car washing.

The housing includes an inner thread formed in the lower portion thereof for threading and engaging with the non-magnetic option coupler. The conductor member includes a socket opening formed in an upper portion thereof for receiving or engaging with the central radiating member.

The housing includes a peripheral flange extended radially and inwardly from the upper portion thereof for engaging with the insulating member and for anchoring and positioning the insulating member in the chamber of the housing.

The conductive coupling element includes a peripheral rib extended radially and outwardly therefrom for engaging with the peripheral flange of the housing and for anchoring and positioning the conductive coupling element to the housing.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 1:
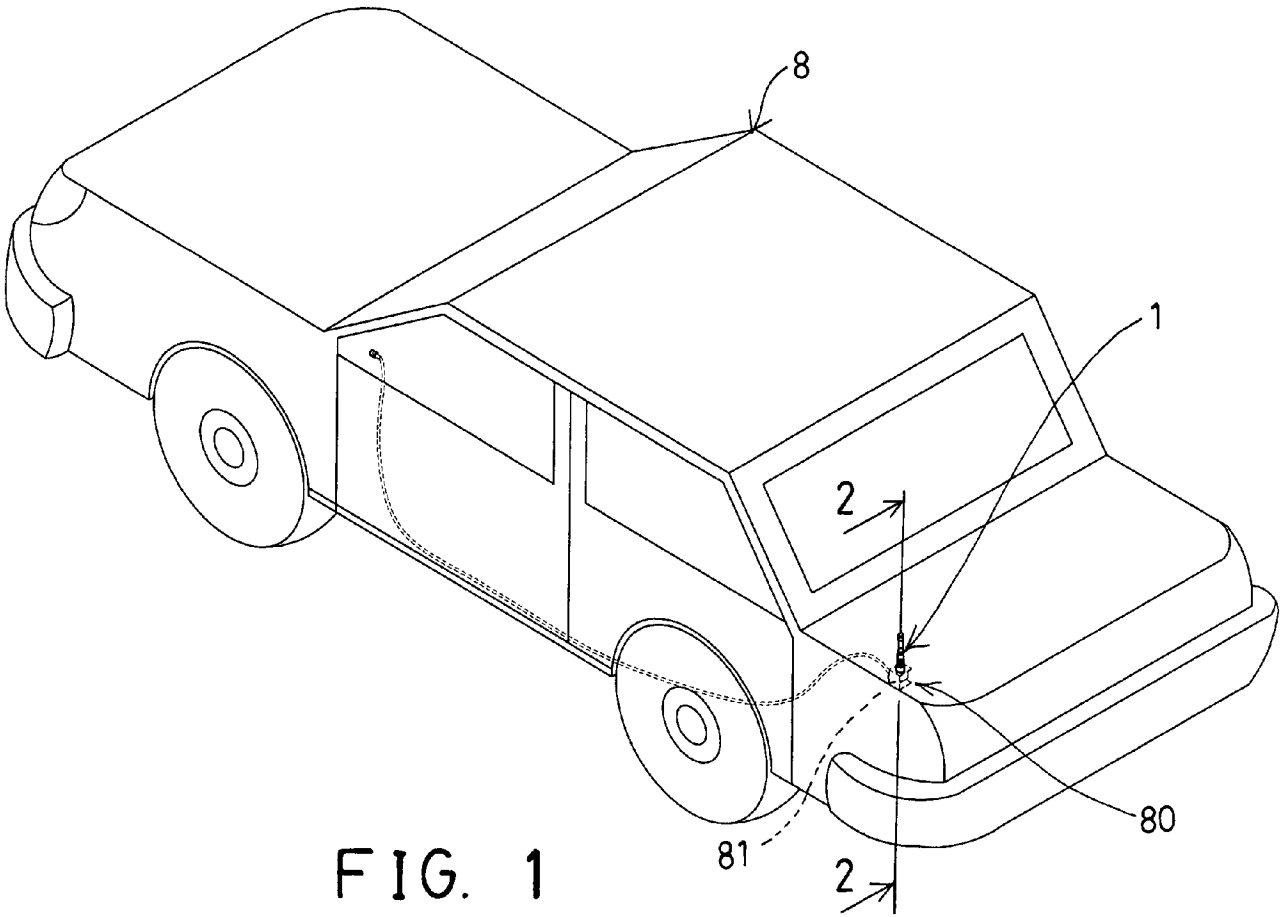
FIG. 1 is a perspective view illustrating an attachment of an antenna device in accordance with the present invention onto a vehicle.

Referring to the drawings, and initially to FIG. 1, an antenna device 1 in accordance with the present invention is provided for attaching onto a vehicle 8 or other objects, such as for coupling to a non-magnetic option coupler 80 of the vehicle 8 with such as a mounting or coupling element or bracket 81 or the like, and the antenna device 1 comprises a coaxial radiating assembly 50 (FIGS. 2-4) attached or mounted to a supporting base 10 which may then be attached or mounted or coupled or secured to the non-magnetic option coupler 80 of the vehicle 8, in which the coaxial radiating assembly 50 includes a relatively shortened length for preventing the antenna device 1 from being damaged by other objects or while car washing.

Figure 2:
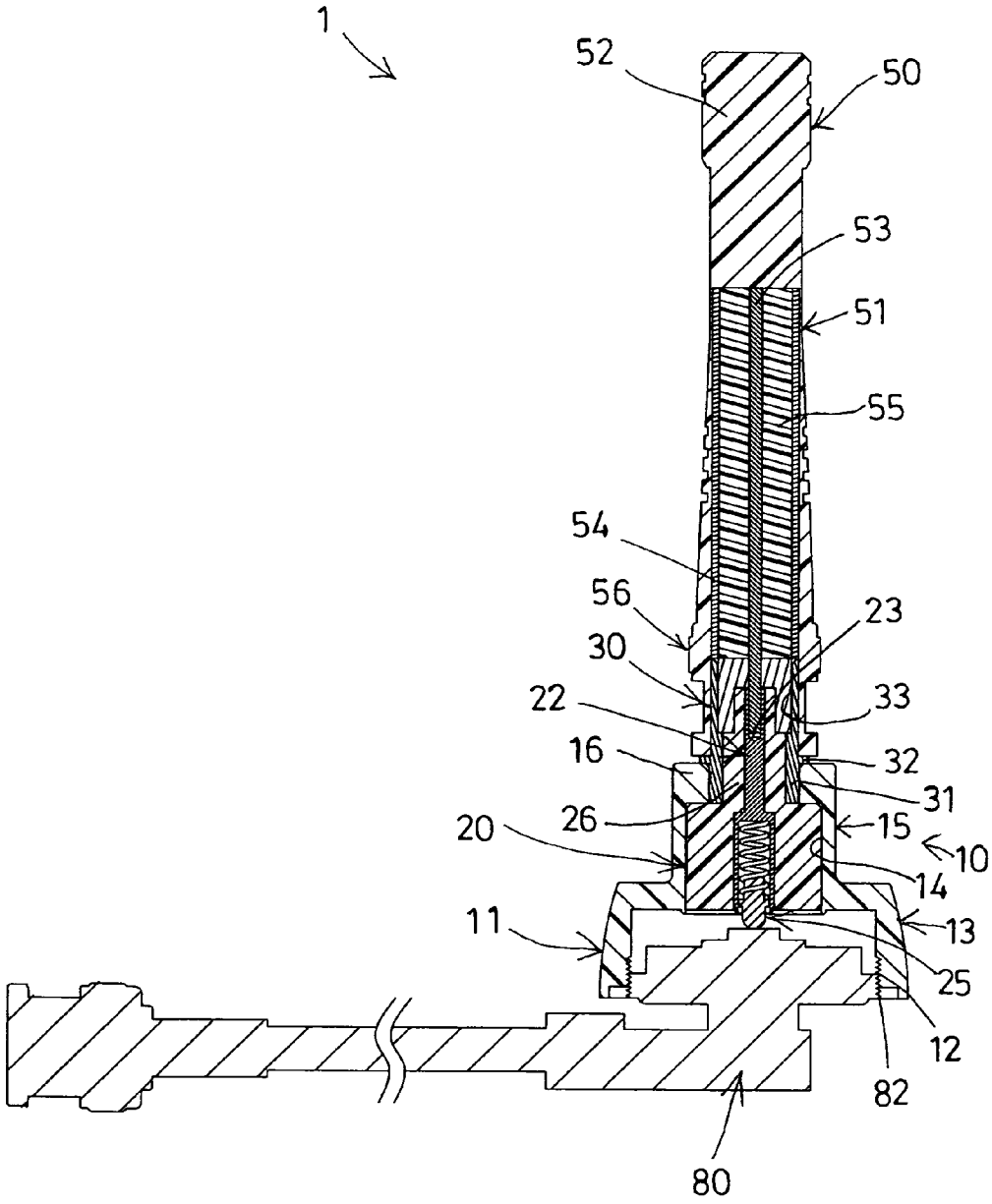
FIG. 2 is a cross sectional view of the antenna device taken along lines 2-2 of FIG. 1.
Figure 3:
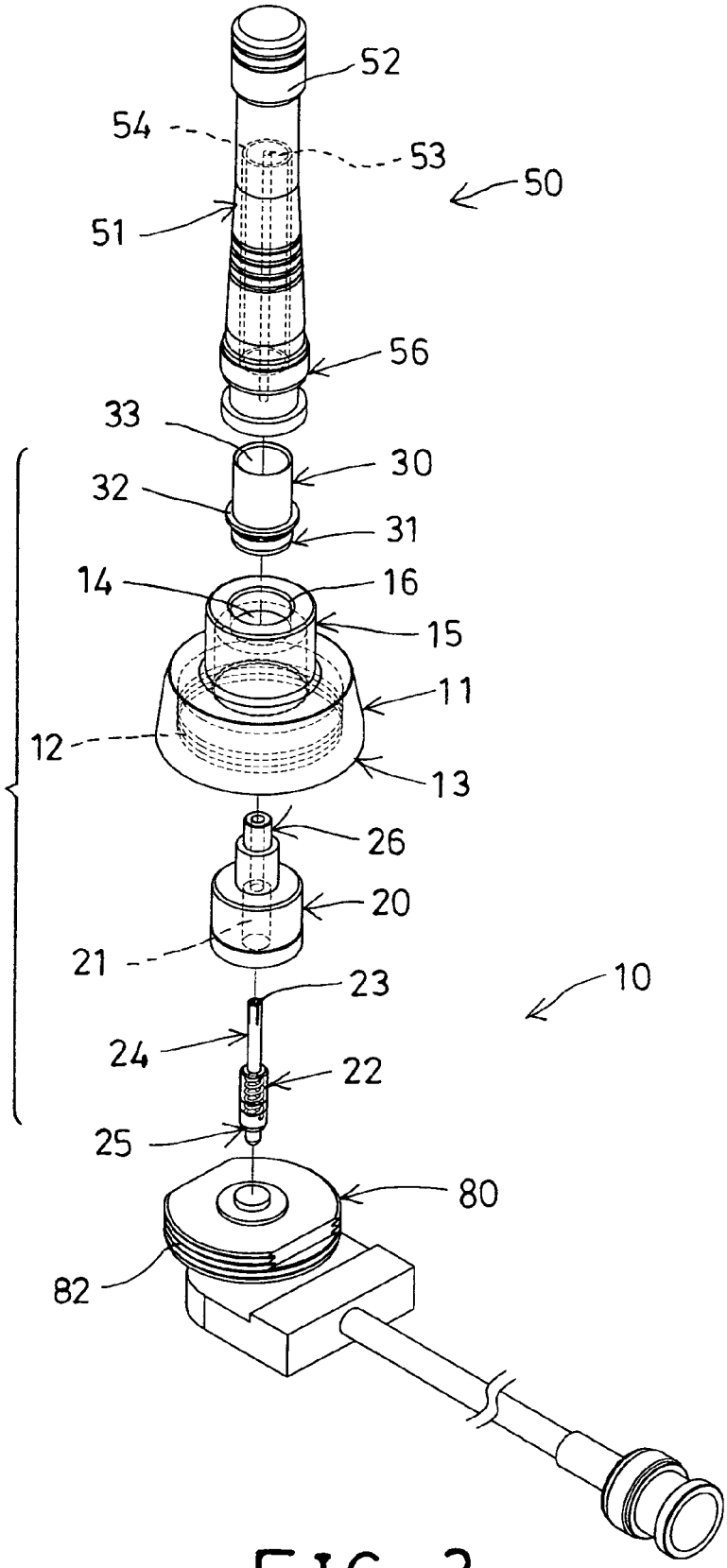
FIG. 3 is a partial exploded view of the antenna device.
Figure 4:
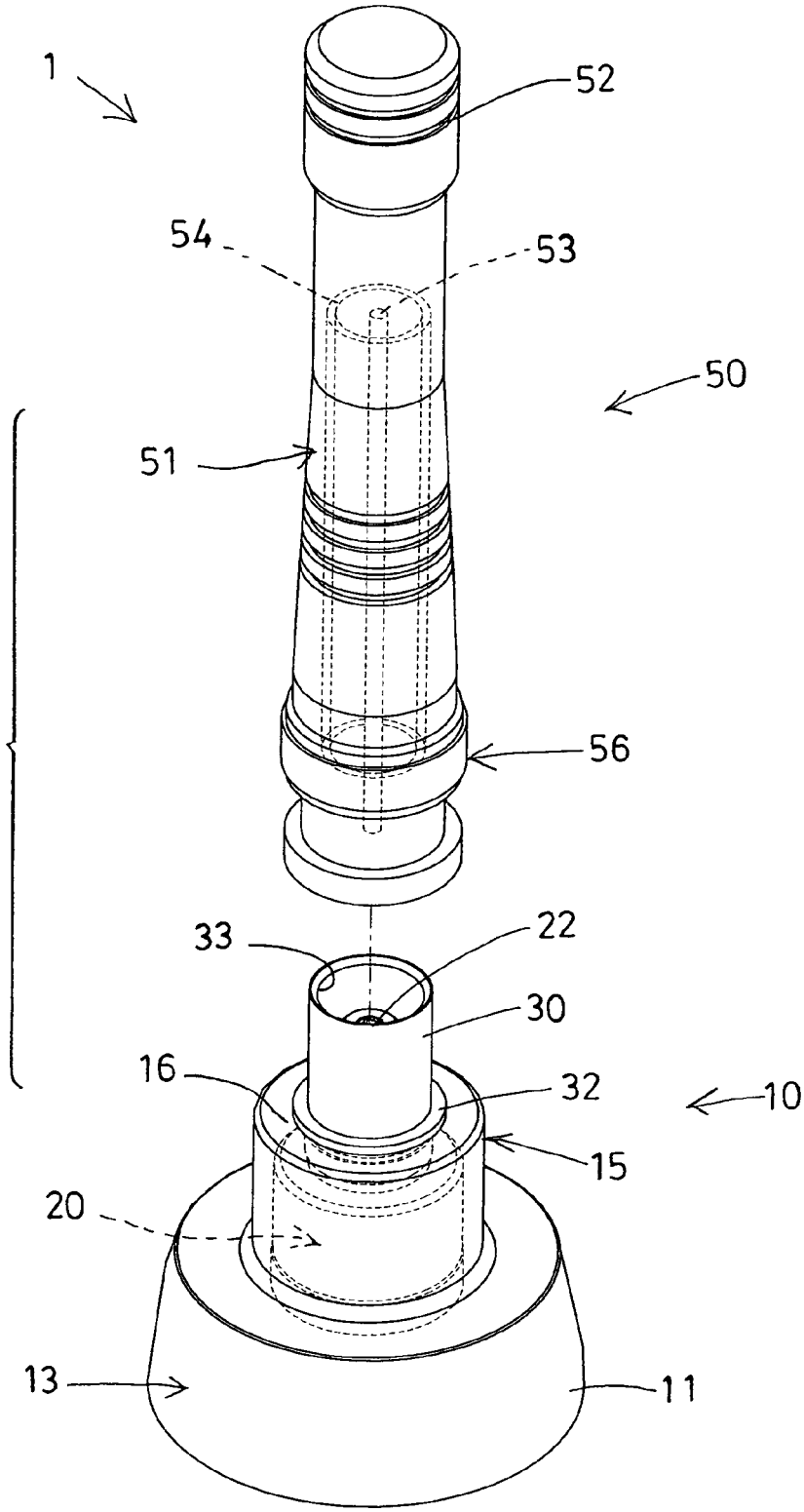
FIG. 4 is another partial exploded view of the antenna device.

As shown in FIGS. 2-4, the supporting base 10 includes an outer housing 11 having an inner thread 12 formed or provided in the lower portion 13 thereof for threading or coupling or engaging with an outer thread 82 of the non-magnetic option coupler 80 of the vehicle 8, and for attaching or coupling or mounting onto the vehicle 8 or other objects, and the outer housing 11 includes a chamber 14 formed therein, such as formed in the middle or upper portion 15 thereof for receiving or engaging with an insulating member 20, and includes a peripheral flange 16 extended radially and inwardly from the upper portion 15 thereof for engaging with the insulating member 20 and for stably anchoring or positioning or retaining the insulating member 20 in the chamber 14 of the housing 11.

The insulating member 20 includes a bore 21 formed therein for receiving or engaging with a conductor member 22 which is engaged into the bore 21 of the insulating member 20 and which is contactable or engageable with the non-magnetic option coupler 80 of the vehicle 8 (FIG. 2), for example, the conductor member 22 includes a socket opening 23 formed in the upper portion 24 thereof (FIG. 3), and includes a lower portion 25 for engaging with the non-magnetic option coupler 80 of the vehicle 8. A conductive coupling element 30 includes a lower portion 31 engaged into the chamber 14 of the housing 11, and includes a peripheral rib 32 extended radially and outwardly therefrom for engaging with the peripheral flange 16 of the housing 11 and for anchoring or positioning or retaining the conductive coupling element 30 to the housing 11.

As best shown in FIG. 2, the conductive coupling element 30 includes a bore or compartment 33 formed therein for receiving or engaging with the upper portion 26 of the insulating member 20 and for stably anchoring or positioning or retaining the conductive coupling element 30 between the upper portion 26 of the insulating member 20 and the peripheral flange 16 or the upper portion 15 of the housing 11, and for allowing the conductive coupling element 30 and the conductor member 22 to be suitably spaced or disengaged or separated from each other with upper portion 26 of the insulating member 20, and for preventing the conductive coupling element 30 and the conductor member 22 from being interfered with each other.

The coaxial radiating assembly 50 includes a coaxial radiating device 51 disposed or attached or mounted or secured in the outer sheath 52, and includes a middle or intermediate or central radiating member 53 and an outer or peripheral or cylindrical radiating member 54, and an insulating element 55 disposed or attached or mounted between the central radiating member 53 and the cylindrical radiating member 54, in which the central radiating member 53 is electrically contactable or engageable with the socket opening 23 of the conductor member 22 for electrically coupling or connecting to the conductor member 22, and the outer or peripheral or cylindrical radiating member 54 is electrically contactable or engageable with the conductive coupling element 30 when the lower portion 56 of the coaxial radiating device 51 or of the coaxial radiating assembly 50 is engaged onto the upper portion of the conductive coupling element 30.

In operation, as shown in FIGS. 1 and 2, the coaxial radiating device 51 or the coaxial radiating assembly 50 includes a middle or intermediate or central radiating member 53 and an outer or peripheral or cylindrical radiating member 54 disposed or arranged coaxially for allowing the length of the antenna device 1 to be suitably reduced or decreased and for allowing the strength of the antenna device 1 to be suitably increased, and for preventing the antenna device 1 from being damaged by other objects or while car washing.

Accordingly, the antenna device in accordance with the present invention may be provided for coupling to a non-magnetic option coupler and for attaching onto vehicles or other objects and for preventing the antenna device from being damaged by other objects or while car washing.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

We claim:

1. An antenna device comprising:

a housing including a lower portion for coupling to a non-magnetic option coupler of a vehicle, and including a chamber formed in an upper portion thereof, an insulating member engaged in said chamber of said housing, and including a bore formed therein, a conductor member engaged into said bore of said insulating member for engaging with the non-magnetic option coupler, a conductive coupling element including a lower portion engaged into said chamber of said housing, and including a compartment formed therein for engaging with an upper portion of said insulating member, and a coaxial radiating assembly including a coaxial radiating device disposed in a sheath, and said coaxial radiating device including a central radiating member for electrically connecting to said conductor member, and including a peripheral radiating member for electrically connecting to said conductive coupling element, and including an insulating element mounted between said central radiating member and said cylindrical radiating member.

2. The antenna device as claimed in claim 1, wherein said conductor member includes a socket opening formed in an upper portion thereof for engaging with said central radiating member.

3. The antenna device as claimed in claim 1, wherein said housing includes a peripheral flange extended radially and inwardly from said upper portion thereof for engaging with said insulating member and for anchoring and positioning said insulating member in said chamber of said housing.

4. The antenna device as claimed in claim 3, wherein said conductive coupling element includes a peripheral rib extended radially and outwardly therefrom for engaging with said peripheral flange of said housing and for anchoring and positioning said conductive coupling element to said housing.

5. The antenna device as claimed in claim 1, wherein said housing includes an inner thread formed in said lower portion thereof for threading and engaging with the non-magnetic option coupler.

* * * * *